US011810498B2

(12) United States Patent
Lin

(10) Patent No.: US 11,810,498 B2
(45) Date of Patent: Nov. 7, 2023

(54) DISPLAY DEVICE AND DISPLAY SYSTEM APPLYING THE SAME

(71) Applicant: BENQ CORPORATION, Taipei (TW)

(72) Inventor: Hsin-Nan Lin, New Taipei (TW)

(73) Assignee: BenQ Corporation, Taipei (TW)

( * ) Notice: Subject to any disclaimer, the term of this patent is extended or adjusted under 35 U.S.C. 154(b) by 0 days.

(21) Appl. No.: 17/744,803

(22) Filed: May 16, 2022

(65) Prior Publication Data

US 2023/0016453 A1 Jan. 19, 2023

(30) Foreign Application Priority Data

Jul. 12, 2021 (CN) ..... 202110784265.5

(51) Int. Cl.
*G09G 3/20* (2006.01)

(52) U.S. Cl.
CPC ..... *G09G 3/2096* (2013.01); *G09G 2370/08* (2013.01); *G09G 2370/20* (2013.01)

(58) Field of Classification Search
CPC ..... G09G 2370/08; G09G 2370/20; G09G 3/2096; G05B 2219/36119; G05B 2219/36325
See application file for complete search history.

(56) References Cited

U.S. PATENT DOCUMENTS 8,762,619 B2 * 6/2014 Sasaki ..... G06F 13/4022 710/316
2004/0075638 A1 * 4/2004 Han ..... G06F 3/023 345/156
2004/0252107 A1 * 12/2004 Tsai ..... G06F 3/03543 345/163
2005/0102462 A1 * 5/2005 Choi ..... G06F 3/038 710/313
2016/0117276 A1 * 4/2016 Park ..... G06F 13/385 710/63
2022/0030191 A1 * 1/2022 Chen ..... H04N 21/43632
2022/0269630 A1 * 8/2022 Lee ..... G06F 13/4022
2023/0016453 A1 * 1/2023 Lin ..... G09G 3/2096

FOREIGN PATENT DOCUMENTS

TW 583577 B 4/2004

OTHER PUBLICATIONS

Office action of counterpart application by Taiwan IP Office dated Jul. 12, 2022.

* cited by examiner

*Primary Examiner* — William Boddie
*Assistant Examiner* — Bipin Gyawali

(57) ABSTRACT

A display system and a display device are provided. The display system includes a host device, a display device and an input device. The display device includes a display controller, a display panel and a USB hub. The display controller processes an image signal provided by the host device with a first processing mode and displays the processed image signal on the display panel. The USB hub is coupled to the host device. The input device is coupled to the USB hub. The input device forms a first signal input path with the host device via the USB hub and a second signal input path with the display controller via a signal line. The input device transmits the control signal via the signal line to cause the display controller to process the image signal with a second processing mode and display the processed image signal on the display panel.

17 Claims, 2 Drawing Sheets

DISPLAY DEVICE AND DISPLAY SYSTEM APPLYING THE SAME

This application claims the benefit of People's Republic of China patent application Serial No. 202110784265.5, filed Jul. 12, 2021, the invention of which are incorporated by reference herein in its entirety.

BACKGROUND OF THE INVENTION

Field of the Invention

The invention relates in general to a system and a device, and more particularly to a display system and a display device.

Description of the Related Art

Along with the advance in display processing technology, it is expected that the display device can adjust various display settings according to users' needs. Under certain circumstances, it is further expected that the display frame can instantly reflect these display settings. For example, for game players, every decimal second counts a lot. Thus, game players will have more response time and better gaming experience if negative influence on the visibility of display frames can be excluded, and some auxiliary effects can be added to the display frames.

SUMMARY OF THE INVENTION

The invention is directed to a display system and a display device. The display device is additionally provided with a port that can be connected to an input device. The port causes the input device to directly communicate with a display controller of the display device to form a signal input path. Once the display controller of the display device receives a control signal from the input device via the signal input path, the display controller can instantly process the image signal.

According to one embodiment of the present invention, a display system is provided. The display system includes a host device, a display device and an input device. The display device includes a display controller, a display panel and a USB hub. The display controller processes an image signal provided by the host device with a first processing mode and displays the processed image signal on the display panel. The USB hub is coupled to the host device. The input device is coupled to the USB hub. The input device forms a first signal input path with the host device via the USB hub and forms a second signal input path with the display controller via a signal line. The input device transmits a control signal via the signal line to cause the display controller to process the image signal with a second processing mode and display the processed image signal on the display panel.

According to another embodiment of the present invention, a display device is provided. The display device is coupled to the host device. The display device includes a casing, a first terminal, an image terminal, a display panel, a display controller and a USB hub. The first terminal is disposed on the casing and coupled to the second terminal of the input device. The image terminal is coupled to the host device to receive an image signal from the host device. The display controller is disposed inside the casing and coupled to the image terminal. The display controller processes the image signal with a first processing mode and displays the processed image signal on the display panel. The USB hub is coupled to the host device and the input device. The input device forms a first signal input path with the host device via a first terminal and the USB hub. The input device further forms a second signal input path with the display controller via a signal line and transmits the control signal to cause the display controller to process the image signal with the second processing mode.

The above and other aspects of the invention will become better understood with regard to the following detailed description of the preferred but non-limiting embodiment(s). The following description is made with reference to the accompanying drawings.

DETAILED DESCRIPTION OF THE INVENTION

The display device of the present invention is additionally provided with a port that can be connected to an input device. The port causes the input device to directly communicate with a display controller of the display device to form a signal input path. Once the display controller of the display device receives control signal from the input device via the signal input path, the display controller can instantly process the image signal.

Detailed descriptions of each embodiment of the present invention are disclosed below with reference to accompanying drawings. Apart from the said detailed descriptions, any embodiments in which the present invention can be used as well as any substitutions, modifications or equivalent changes of the said embodiments are within the scope of the present invention, and the descriptions and definitions in the claims shall prevail. Many specific details and embodiments are disclosed in the specification for anyone ordinary skilled in the art to comprehensively understand the present invention, not for limiting the present invention. Moreover, generally known procedures or elements are not disclosed to avoid adding unnecessary restrictions to the present invention.

Figure 1:
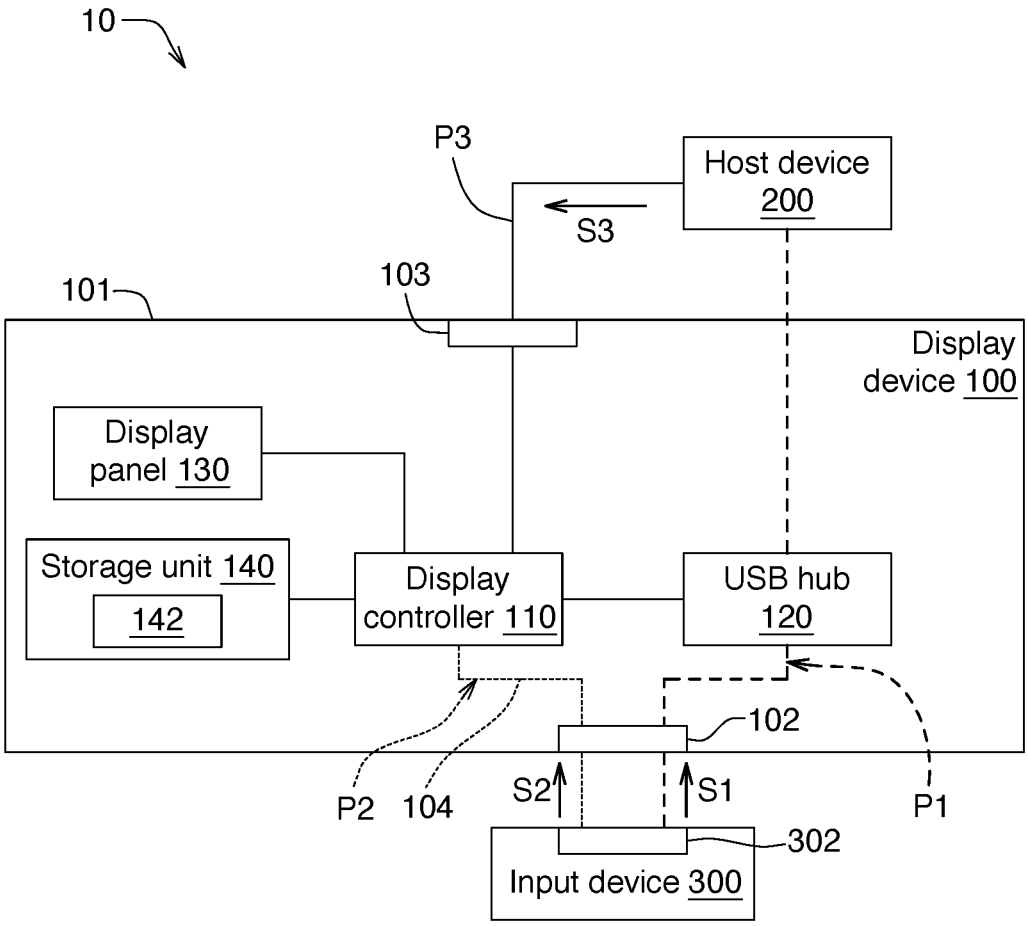
FIG. 1 is a simplified functional block diagram of a display system according to an embodiment of the present invention.

Referring to FIG. 1, a simplified functional block diagram of a display system 10 according to an embodiment of the present invention is shown. The display system 10 includes a display device 100, a host device 200 and an input device 300, wherein the host device 200 and the input device 300 respectively are coupled to the display device 100. The host device 200 can be realized by any computing device with programmable function such as PCs, laptops, tablets, smartphones, or workstations. Examples of the input device 300 include mouse, keyboard, trackpad, and joystick. In the present embodiment, the input device 300 is exemplified by a mouse, but other types of input device can also be used.

The display device 100 includes a casing 101, a first terminal 102, an image terminal 103, a display controller 110, a USB hub 120 and a display panel 130. The first terminal 102, the image terminal 103, the display controller 110, the USB hub 120 and the display panel 130 are disposed on the casing 101. The display controller 110 is coupled to the USB hub 120 and the display panel 130 respectively.

In an illustrative rather than a restrictive sense, the display panel 130 can be realized by an LCD panel, a light emitting diode (LED) panel, an organic light emitting diode (OLED) panel, an electroluminescent display panel, a plasma display panel, or a quantum dot display panel. The image terminal 103 is coupled to the host device 200 to receive an image signal S3 from the host device 200. Moreover, the image terminal 103 is coupled to the image controller 110 to transmit the received image signal S3 to the display controller 110. Thus, the host device 200 forms an image signal input path P3 with the display controller 110 of the display device 100 via the image terminal 103. The display controller 110 may include a scaler for performing image scaling and/or image overlaying on the received image signal S3 with the first processing mode.

The first terminal 102 is coupled to the second terminal 302 of the input device 300. Furthermore, the first terminal 102 is coupled to the display controller 110 and the USB hub 120 respectively to cause the input device 300 to transmit different signals to the display device 100 via two paths. The USB hub 120 can receive an operating signal S1 from the input device 300 via the first terminal 102. The USB hub 120 is coupled to the host device 200 to transmit the operating signal S1 to the host device 200. Thus, the input device 300 forms a first signal input path P1 with the host device 200 via a first terminal 102 and the USB hub 120. The first signal input path P1 complies with USB 2.0 or 3.0 transmission specification. The operating signal S1 is for performing relevant operations of the host device 200. For example, when the input device 300 is a mouse, the operating signal S1 can be ordinary operating instructions of a mouse, such as cursor movement and clicking. In an exemplary embodiment, when a player plays game with a mouse, the host device 200 can execute main operations of the game, such as the movement of characters in the game, in response to the operating signal S1.

Besides, the input device 300 can form a second signal input path P2 with the display controller 110 via a signal line other than the first signal input path P1. The second signal input path P2 is electrically connected to the display controller 110 via the transmission interface of an inter-integrated circuit (I2C). Thus, the display controller 110 receives the control signal S2 from the input device 300 via the first terminal 102 to cause the display controller 110 to process the image signal S3 with the second processing mode to adjust brightness, contrast, color temperature, enhancement of dark areas, increase in the frequency of black-insertion. The contents of image processing in the second processing mode are different from that in the first processing mode. Thus, the display controller 110 can process the image signal S3 with the first processing mode and the second processing mode and then display the images processed with the first and second processing modes on the display panel 130.

As indicated in FIG. 1, the first terminal 102 can be provided with a connection line 104 connected to the signal line and the display controller 110. The connection line 104 can be realized by an I2C signal line. In an exemplary embodiment, the first terminal 102 can be realized by a USB transmission interface, and at least is a connection interface capable of supporting USB 3.0 and above. Some of the contacts of the connection interface complying with the abovementioned specification can be connected to the USB hub 120 to form a part of the first signal input path P1 complying with USB transmission specification (such as USB 2.0 transmission specification); other contacts can be connected to the display controller 110 to form a part of the second signal input path P2 complying with I2C specification.

Figure 2:
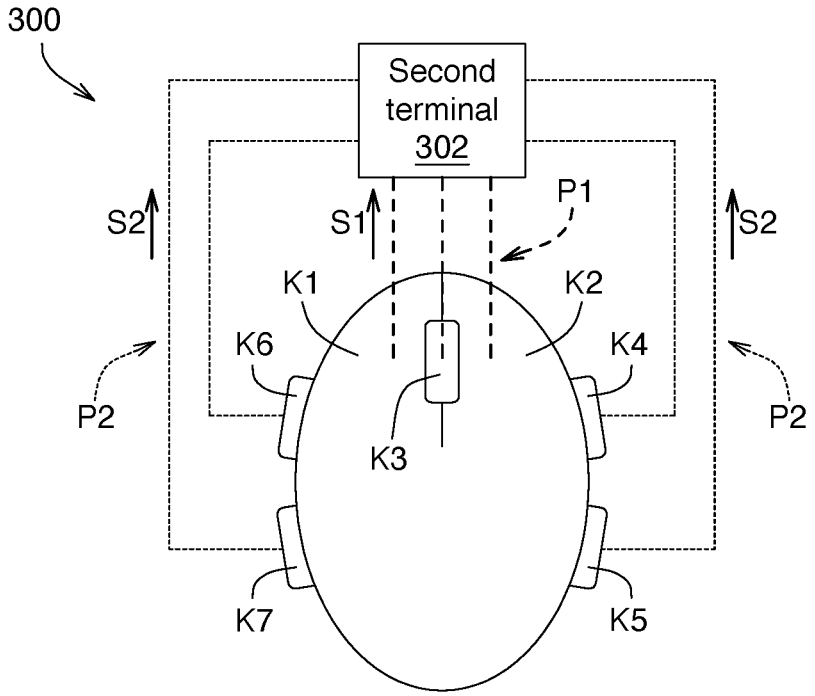
FIG. 2 is a schematic diagram of an input device according to an embodiment of the present invention.

The operating signal S1 and the control signal S2 can be emitted via different keys of the input device 300. Referring to FIG. 2, a schematic diagram of an input device 300 according to an embodiment of the present invention is shown. The input device 300 includes at least one main key K1, K2, and K3 and at least one specific key K4, K5, K6, and K7. In an illustrative rather than restrictive sense, the main keys K1, K2, and K3 respectively are standard left, right and scroll keys of a mouse, the specific keys K4, K5, K6, and K7 are additional hotkeys other than the standard left, right and scroll keys of a mouse. In the present embodiment, the main controller (not illustrated) of the input device 300 can transmit an operating signal S1 using the main keys key K1, K2, and K3 via the first signal input path P1 operate the host device 200; the main controller (not illustrated) of the input device 300 can transmit the control signal S2 using the specific keys K4, K5, K6, and K7 via the second signal input path P2 to cause the display controller 10 to process the image signal S3 with the second processing mode.

Figure 3:
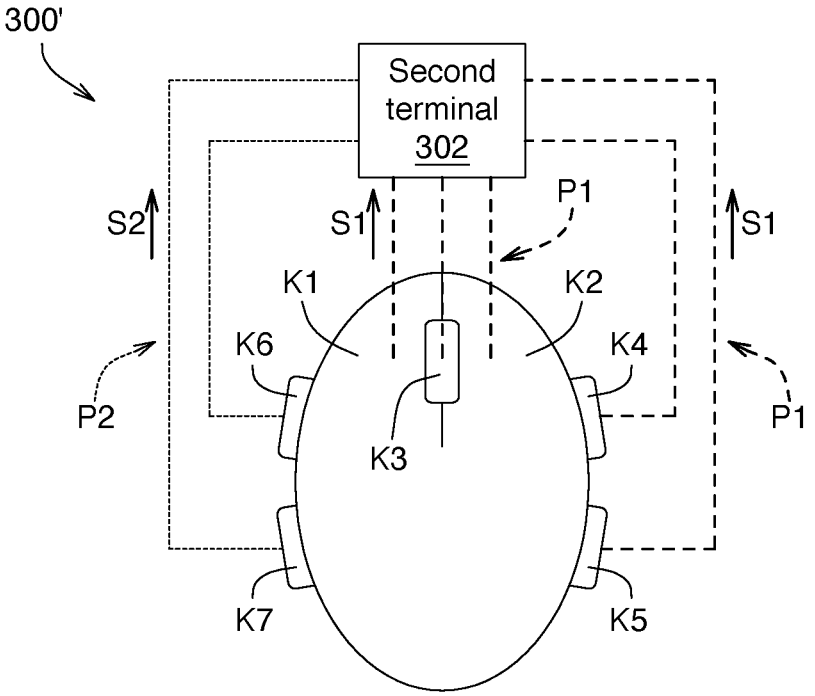
FIG. 3 is a schematic diagram of an input device according to another embodiment of the present invention.

The implementation of the input device 300 of the present invention is not limited to FIG. 2. Referring to FIG. 3, a schematic diagram of an input device 300' according to another embodiment of the present invention is shown. In the present embodiment, the main controller (not illustrated) of the input device 300 can transmit the operating signal S1 using the main keys K1, K2, and K3 via the first signal input path P1. Additionally, the main controller of the input device 300 (not illustrated) can transmit the operating signal S1 using some specific keys other than the main keys K1, K2, and K3, such as specific keys K4 and K5, via the first signal input path P1. The main controller (not illustrated) of the input device 300 still can transmit the control signal S2 using the remaining specific keys K6 and K7 via the second signal input path P2.

As indicated in FIG. 1 and FIG. 2, the display device 100 further includes a storage unit 140, which stores relevant programming codes of an on-screen display (OSD) menu 142. The OSD menu 142 can define each second processing mode corresponding to the control signal S2 transmitted using the specific keys K4, K5, K6, and K7. Thus, the second processing mode can be defined and selected by the OSD menu 142. When the display controller 110 receives the control signal S2 of a specific key, the display controller 110 can process the image signal S3 according to the corresponding second processing mode. An embodiment of the OSD menu 142 is exemplified in Table 1:

TABLE 1

| Specific Key | Processing Mode |
|---|---|
| Specific key K4 | Reduce motion blur |
| Specific key K5 | Reduce smoke |
| Specific key K6 | Picture mode |
| Specific key K7 | Zoom in/out |

The OSD menu 142 as illustrated in Table 1 is applicable to game scenarios. On one hand, the player can execute main operations of a game using the main keys K1~K3 of the input device 300; on the other hand, the player can transmit a corresponding control signal S2 to the display controller 110 using the specific keys K4~K7 to execute specific image processing. For example, the player can press the specific key K4 to reduce motion blur, such that the game can be more smoothly played, and gaming experience can be enhanced. In an embodiment, the control signal S2 can be realized by a long tap signal, a single tap signal or a double tap signal.

Besides, the input device 300 can synchronously output the operating signal S1 and the control signal S2. That is, when executing main operations of the game, the player can synchronously press the specific keys K4~K7 to instantly execute specific image processing.

According to the display system and the display device of the present invention, the input device not only can form a first signal input path with the display device and the host device, but also can form an additional unshared second signal input path with the display device. Once the display controller of the display device receives the control signal from the input device via the second signal input path, the display controller can instantly process the image signal.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A display system, comprising:

a host device;

a display device, comprising:

a display controller;

a display panel, wherein the display controller processes an image signal provided by the host device with a first processing mode and displays the processed image signal on the display panel; and a USB hub coupled to the host device; and an input device coupled to the USB hub and disposed outside the display device, wherein the input device forms a first signal input path with the host device via the USB hub, forms a second signal input path with the display controller via a signal line without via the USB hub, and transmits a control signal via the signal line without via the USB hub to cause the display controller to process the image signal with a second processing mode being reducing motion blur, reducing smoke, picture mode or zooming in/out and display the processed image signal on the display panel, wherein the input device is configured to input an operating signal being ordinary operating instructions of a mouse to the host device via the first signal input path and input the control signal to the display controller via the second signal input path; the input device can synchronously output the operating signal and the control signal.

2. The display system according to claim 1, wherein the input device comprises at least one main key and at least one specific key; the at least one main key is configured to operate the host device via the first signal input path; the at least one specific key is configured to transmit the control signal via the second signal input path to cause the display controller to process the image signal with the second processing mode.

3. The display system according to claim 1, wherein the input device comprises at least one main key and at least one specific key; the at least one main key and a part of the at least one specific key is configured to operate the host device via the first signal input path; the other part of the at least one specific key is configured to transmit the control signal via the second signal input path to cause the display controller to process the image signal with the second processing mode.

4. The display system according to claim 1, wherein the second signal input path is electrically connected to the display controller via the transmission interface of an inter-integrated circuit ($I^2C$).

5. The display system according to claim 1, wherein the first signal input path complies with USB 2.0 or 3.0 transmission specification.

6. The display system according to claim 1, wherein the input device is connected to the display device via a USB transmission interface, and the second signal input path complies with inter-integrated circuit ($I^2C$) transmission specification.

7. The display system according to claim 1, wherein the second processing mode is defined and selected by an on-screen display (OSD) menu of the display device.

8. The display system according to claim 1, wherein the control signal is a long tap signal, a single tap signal or a double tap signal.

9. A display device coupled to a host device, wherein the display device comprises:

a casing;

a first terminal disposed on the casing and coupled to a second terminal of an input device disposed outside the casing;

an image terminal coupled to the host device to receive an image signal from the host device;

a display panel;

a display controller disposed inside the casing and coupled to the image terminal, wherein the display controller processes the image signal with a first processing mode and displays the processed image signal on the display panel; and a USB hub coupled to the host device and the input device, wherein the input device forms a first signal input path with the host device via a first terminal and the USB hub; the input device further forms a second signal input path with the display controller via a signal line without via the USB hub and transmits a control signal via the signal line without via the USB hub to cause the display controller to process the image signal with a second processing mode being reducing motion blur, reducing smoke, picture mode or zooming in/out, wherein an operating signal being ordinary operating instructions of a mouse is transmitted to the host device via the first signal input path; the control signal is transmitted to the display controller the second signal input path; the operating signal and the control signal can be synchronously transmitted via the first signal input path and the second signal input path.

10. The display device according to claim 9, wherein at least one main key of the input device transmits an operating signal to the host device via the first signal input path to operate the host device; at least one specific key of the input device transmits the control signal via the second signal input path to cause the display controller to process the image signal with the second processing mode.

11. The display device according to claim 9, wherein at least one main key of the input device and a part of at least one specific key transmit an operating signal to the host device via the first signal input path to operate the host device; the other part of the at least one specific key of the input device transmits the control signal via the second signal input path to cause the display controller to process the image signal with the second processing mode.

12. The display device according to claim 9, wherein the second signal input path is electrically connected to the display controller via the transmission interface of an inter-integrated circuit ($I^2C$).

13. The display device according to claim 9, wherein the first signal input path complies with USB 2.0 or 3.0 transmission specification.

14. The display device according to claim 9, wherein the first terminal is a USB transmission interface, and the second signal input path complies with inter-integrated circuit ($I^2C$) transmission specification.

15. The display device according to claim 9, wherein the second processing mode is defined and selected by an on-screen display (OSD) menu of the display device.

16. The display device according to claim 9, wherein the control signal is a long tap signal, a single tap signal or a double tap signal.

17. The display device according to claim 9, wherein the first terminal has a connection line connected to the signal line and the display controller.

* * * * *